US011033169B1

(12) United States Patent
Rozner et al.

(10) Patent No.: US 11,033,169 B1
(45) Date of Patent: Jun. 15, 2021

(54) DISPOSABLE TOWEL AND PAD HOLDING APPARATUS

(71) Applicants: Marvin John Rozner, Wichita, KS (US); Richard Clay Steelsmith, Wichita, KS (US)

(72) Inventors: Marvin John Rozner, Wichita, KS (US); Richard Clay Steelsmith, Wichita, KS (US)

( * ) Notice: Subject to any disclaimer, the term of this patent is extended or adjusted under 35 U.S.C. 154(b) by 237 days.

(21) Appl. No.: 16/033,195

(22) Filed: Jul. 11, 2018

(51) Int. Cl.
*A47L 13/12* (2006.01)
*A47L 13/16* (2006.01)
*A47L 13/50* (2006.01)

(52) U.S. Cl.
CPC ..... *A47L 13/50* (2013.01); *A47L 13/12* (2013.01); *A47L 13/16* (2013.01)

(58) Field of Classification Search
CPC ..... A47L 13/12; A47L 13/16; A47L 13/50; A47K 1/00
See application file for complete search history.

(56) References Cited

U.S. PATENT DOCUMENTS

| | | | | |
|---|---|---|---|---|
| 6,786,377 | B1 * | 9/2004 | Holden | B65H 35/10 225/106 |
| 7,955,683 | B1 * | 6/2011 | Ferrell | A47K 10/02 15/209.1 |
| 8,307,489 | B1 * | 11/2012 | Adame | A63B 55/408 15/105 |
| 10,322,325 | B2 * | 6/2019 | Farina | A47L 13/16 |
| 2015/0071978 | A1 * | 3/2015 | Chang | A61N 2/06 424/402 |

* cited by examiner

*Primary Examiner* — Michael D Jennings

(57) ABSTRACT

A Disposable Towel and Pad Holding Apparatus is disclosed. The apparatus relates to the use of disposable towels, sheets, pads, nonwovens, and textiles for wiping, cleaning, dusting, polishing and absorbing in a method that allows for an improved experience over prior arts. The apparatus is comprised of a permanent towel-like main body comprised of various possible fabric(s) and/or other assorted materials possessing certain property compositions to serve a variety of needs. It also possesses a means of temporarily connecting and securing various forms of disposable towels, sheets, pads, absorbents and nonwoven textiles to one side of the embodiments main body. The disposable means can be temporarily attached to one side prior to a cleaning task and removed and discarded following completion of the task. The waterproof characteristics of the embodiment protect the users hand from liquid cleaners, chemicals and moisture from spills. The apparatus itself is multi-use in its operation.

2 Claims, 3 Drawing Sheets

Reference Numerals for the components of Disposable Towel and Pad Holding Apparatus 100 Disposable Towel and Pad Holding Apparatus
10 Waterproof Gripper Fabric Layer
12 Button Magnet-Positive Polarity
14 Waterproof Fabric Corner Tab
16 Button Magnet-Negative Polarity
20 Adhered or Sewn Border Binder
30 Disposable Towel or Pad Reference Numerals for the components of Disposable Towel and Pad Holding Apparatus

| | |
|---|---|
| 100 | Disposable Towel and Pad Holding Apparatus |
| 10 | Waterproof Gripper Fabric Layer |
| 12 | Button Magnet-Positive Polarity |
| 14 | Waterproof Fabric Corner Tab |
| 16 | Button Magnet-Negative Polarity |
| 20 | Adhered or Sewn Border Binder |
| 30 | Disposable Towel or Pad |

SIDE VIEW

DISPOSABLE TOWEL AND PAD HOLDING APPARATUS

We, Marvin Rozner, 2685 N Bayside St, Wichita Kans., USA, and Richard Steelsmith, 7226 E Cedaridge Circle, Wichita, Kans., USA, have developed a Disposable Towel and Pad Holding Apparatus as an alternative to the traditional multi-use towel and the single or limited use disposable towels. Our Disposable Towel and Pad Holding Apparatus addresses the inherent problems and limitations with the prior art multiuse towels and disposable only towels or wipes.

CLAIM TO PRIORITY OF EARLIER FILED APPLICATION(S)

This application claims the benefit of U.S. Provisional Application No. 62/531,435 filed Jul. 12, 2017.

CROSS-REFERENCE TO EARLIER FILED APPLICATION(S)

The disclosure of U.S. Provisional Application No. 62/531,435 filed on Jul. 12, 2017 is incorporated herein by reference in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

(a) Field of the Invention

The embodiment most generally relates to a towel apparatus used for cleaning, wiping, dusting, polishing and/or absorbing. More particularly, the embodiment relates to an apparatus which utilizes the temporary attachment and detachment of disposable towels, sheets, pads, absorbents, and all forms of nonwoven textiles, and that is used primarily as a means for disposable wiping, cleaning, dusting, polishing, and/or absorbing.

(b) Description of the Prior Art

Various forms and styles of cleaning cloths and methods of using various cleaning implements have been disclosed in the prior art as being useful for wiping off dirt and grime, to generally dean, to polish, and/or to absorb liquids or liquid spills. Many of these embodiments are in the form of a multi-use clothlike towel or a disposable paper, nonwoven textile or similar towel, sheet or pad. The primary drawback of the current multi-use towels or pads is that once they are used a few times, a considerable buildup of gunk, dirt, grime and even bacteria become present on the wiping surface of the towel or pad. This accumulation becomes even more predominant if the user is applying a liquid cleaner to that towel or pad during cleaning. As this buildup increases over time, the user is essentially reapplying a portion of that accumulated gunk, dirt and grime back onto the surface they are attempting to clean, as opposed to wiping it off or cleaning the desired surface. Due to these undesirable circumstances, many will opt to use a disposable cloth, towel, sheet, pad, nonwoven material or absorbent for their cleaning purposes, both for convenience and to avoid the previously described pitfalls of the multi-use towel. The problem with disposables is that their non-waterproof characteristics can make for messy hands and can also permit undesirable cleaners or chemicals to come into to contact the hands. There have been many prior art devices that combine a cleaner impregnated into one or multiple layers of the disposable towel/sheet, but this additive and the cost of impregnating this additive into the disposable means can be quite costly. While there are prior art implements that are designed for attaching a disposable means for cleaning, many these devices are rigid in nature, bulky and inconvenient for storing or carrying easily. Their rigid structure allows for cleaning flat, hard surfaces but does not offer a viable solution to the cleaning of irregular or round shaped surfaces or objects.

DESCRIPTIONS OF RELATED ARTS

U.S. Pat. No. 20130227805A1 Maharaj describes a Two in One Cleaning Towel of disposable nature. While this addresses the negative issues inherent to using a reusable towel, it does not address the transfer of the cleaner that it possesses from contacting the users hand and contaminating or harming their skin. As one side of the device has a cleaning agent or disinfectant impregnated into it, it prohibits the user from using a cleaning agent of their choice. Additionally, even if the cleaning agent is dry in nature, there would still be a measurable transference of residue from that agent onto the user's hand.

U.S. Pat. No. 20150351601A1 Butts, Tadin describes an implement that is designed to attach and detach a disposable cleaning towel or towels. This device, however, is rigid and bulky in its nature. These characteristics make storage and carrying or transporting from one place to another tedious, limited, and inconvenient. Furthermore, while the device might work well on flat, hard surfaces, its rigid nature would make it quite difficult to effectively clean rounded or irregular shaped surfaces or objects.

U.S. Pat. No. 7,163,349B2 Policicchio, Rhamy, Ducing, Willman, Jackson describes a device that is designed to attach and detach disposable cleaning wipes or towels, but represents a cumbersome unit with a large handle, designed mainly towards cleaning floors, and is therefore very limited in its variety of cleaning uses. There are many devices of this nature that are large, bulky, rigid, and limited as to their use for cleaning.

U.S. Pat. No. 5,639,532A Wells describes a device that is designed for cleaning that includes multiple layers, one layer of which contains a liquid cleaning solution, one layer which contains a drying towel, and one impermeable liner layer. These layers are folded in a manner as to use each layer independently. The layers are permanently bonded to each other forming one complete unit, creating an inability for the user to discard one layer separate from any other layer, as well as the previously mentioned downside of having one ply impregnated with a cleaner.

BRIEF SUMMARY OF THE INVENTION

Although others have invented a vast assortment of multi-use and disposable towel or pad designs, several aspects of the Disposable Towel and Pad Holding Apparatus are superior for many reasons. The Disposable Towel and Pad Holding Apparatus is applicable to an array of industries, markets, households, and institutions that would currently use towels for tasks such as, but certainly not limited to cleaning, dusting, wiping, absorbing, applying cleaners or liquids, polishing, and drying.

The embodiment is comprised of a permanent, reusable, flexible towel-like main body. This main body is comprised of two waterproof bodies of material that also possess a textured, tacky, gripping characteristic. These two bodies of material are equal in size and are aligned at their corresponding edges, then bonded or sewn together at their border, insuring that the textured, tacky, gripping sides are facing outward, ultimately creating one unified body having a first side and a second side. These two sides of the apparatus differ in their functionality. The first side is the textured, tacky, gripping side that would contact the user's hand during use and provide a no-slip grip. The second side would incorporate a means of easily and temporarily attaching, securing, and detaching various forms of disposable towels, sheets, pads, nonwoven textiles or absorbents. The desired disposable component is attached in a way that allows for the removal of a dirty, used component and the installation of a new, clean disposable component in a quick, convenient, and easy manner. To achieve this, each corner on the second side of the Apparatus has been designed in a manner that allows for temporarily attaching the disposable component. Each corner contains a pair of small button magnets, one sewn securely to or within the main body, and one sewn within a small triangular corner flap of material, which is then sewn to each corner of the main body on the two outermost edges of the flap, leaving the innermost edge of the triangular flap of material free. This configuration allows the corners of the desired disposable component to be tucked underneath the triangular flap and in between the two magnets, holding it securely, yet temporarily, in place.

For descriptive purposes in this application, we will reference the sports industry, with the fact being recognized that this apparatus is not limited to the sports industry or any one specific industry for that matter. The Disposable Towel and Pad Holding Apparatus is applicable in its use to a variety of sports, especially to those that inherently require keeping equipment clean as a means of achieving optimum performance, such as bowling or golf. For purposes of example in this application, the embodiment will be described as it relates to the sport of bowling, although, as previously referenced, it's use is certainly not limited to sports in general, or only to the sport of bowling specifically. The embodiment sets itself apart from other similar product options in the sporting industry in its uniqueness of design and functionality. It addresses some inherent pitfalls of multi-use towels, while expanding on various inherent advantages of disposable towels by providing protection from any type of moisture that might be transferred or applied to that disposable agent from contacting the user's hand, which can be vital to performance in any sport which involves gripping a piece of equipment. Additionally, it's flexible towel-like nature allows for cleaning surfaces of all shapes and irregularities. The primary use of the embodiment as it relates to the sport of bowling, would be to wipe any existing lane oil, dirt, grime and other foreign substances from the bowling ball's surface that would prove to be detrimental to the ball's performance. The design characteristics of the embodiment allow for it to be used in a multi-functional manner. It can be used with a dry disposable component, to wipe the lane oil, dirt, grime, and other foreign substances from the ball during play, or with a wet disposable component infused with an approved liquid cleaner specifically designed to remove those foreign substances from the surface of the ball. The embodiment can be used in either manner during play (when allowed by rules), upon the completion of, or prior to play, or any other time the user desires to clean the surface of the ball's cover stock.

All other previously known towel options in the sport are intended for multi-use operation and purpose, creating a variety of undesirable circumstances brought on by their recurrent use. The embodiment addresses these problems by providing an opportunity to use an inexpensive disposable means while enjoying a waterproof main body which protects the user's hands from any liquids, cleaners, and/or chemicals. The disposable means can be temporarily attached to the Disposable Towel and Pad Holding Apparatus prior to cleaning and removed immediately after cleaning, allowing the disposable means to be thrown away and the Disposable Towel and Pad Holding Apparatus to be reused for an unlimited number of future cleanings. The embodiment will accept installation of many different forms of disposable towels, sheets, pads, absorbents, and/or nonwoven textiles, allowing the user to choose the specific and best means for the intended cleaning task. Additionally, with the Disposable Towel and Pad Holding Apparatus, the user is free to use a cleaner, degreaser, dusting solution or any other cleaning-based liquid of their choice, if desired, while enjoying an implement that keeps their hands free from contact with the liquid cleaner.

Advantages

The primary advantage of the Disposable Towel and Pad Holding Apparatus is that it addresses the specific problem inherent to all multi-use towels currently available. The primary drawback of the multi-use towels or pads as they pertain to the sport of bowling, is that once they are used a few times, a large buildup of lane oil, dirt, and grime become present on the wiping surface of the towel or pad. This buildup becomes even more predominant if the user is applying a liquid ball cleaner to that towel or pad. However, this accumulation would still occur even if using the towel in its dry form. As this build up continues, session after session, the user is basically reapplying a portion of that accumulated lane oil, dirt and grime back onto the surface of the ball, as opposed to wiping it off with a cleaner towel surface. At some point, the user is forced to either inconveniently wash that towel, which can be a messy endeavor given the amount of dirt and lane oil that is embedded into it or purchase a new one. A vital characteristic of our Disposable Towel and Pad Holding Apparatus, is that it allows the user to inexpensively and conveniently utilize a fresh, new, clean disposable component for each session of bowling, or as often as required or desired. This attribute greatly reduces the shortcoming of reapplying built up lane oil, dirt, grime, and other foreign substances from the surface of the towel back onto the surface of the bowling ball, an unfavorable characteristic of multi-use towels. This is a very important attribute, since the accumulation of lane oil, dirt, grime and other foreign substances on the surface of the bowling ball all directly reduce the hooking performance of that bowling ball. The cleaner the surface of the bowling ball is maintained, the more consistent and efficient performance the ball will have in gripping the lane, for a stronger hook and better pin action.

A further advantage of the Disposable Towel and Pad Holding Apparatus is that it eliminates the problematic issue of carrying a wet, dirty, oily towel or cleaning pad in the user's bowling bag. That wet, dirty, grimy towel or pad can transfer those elements onto the user's bowling shoes, wrist devices, or any other accessories that the user might store in that bowling bag, creating a multitude of negative outcomes. The embodiment eliminates that concern, given that the used, disposable component is simply removed and discarded prior to packing away the Disposable Towel and Pad Holding Apparatus into the bowling bag at the end of a bowling session.

Another distinct advantage of the Disposable Towel and Pad Holding Apparatus is the importance of its waterproof characteristic. The waterproof feature of the embodiment allows for the application and use of liquid cleaners onto the disposable component, without producing the undesired issue of any liquid, oil, and/or dirt from being transferred through the layers of the apparatus onto the user's hand on the opposite side of the apparatus. It is vital that the bowler's hand(s) stay dry for gripping purposes, insuring a proper and consistent grip and release of the bowling ball.

Additionally, both the first side and the second side of the embodiment are comprised of a material that displays a textured, tacky, gripping characteristic. The textured, tacky, gripping characteristic on the first side of the main body, aids in providing a controllable, no slip grip, as the user wipes the towel over the surface of the bowling ball. The second side of the main body is also comprised of a gripping material and represents the surface that the disposable component would rest against when attached via the magnetic corner tabs to the embodiment. This would provide a gripping surface for the disposable component to cling to, serving to prevent the disposable component from slipping or moving around when in use. Should the main body be comprised of two non-waterproof bodies of material, an additional embodiment would call for a waterproof material layer to be sandwiched between the two layers to maintain the waterproof characteristic.

BRIEF DESCRIPTION OF SEVERAL VIEWS OF THE DRAWINGS

We have included 3 drawings of the Disposable Towel and Pad Holding Apparatus. While the illustrations depict a singular embodiment of the present invention, the invention is certainly not limited to the precise arrangements and instrumentalities described.

REFERENCE NUMERALS FOR THE COMPONENTS OF DISPOSABLE TOWEL AND PAD HOLDING APPARATUS

100 Disposable Towel and Pad Holding Apparatus
10 Waterproof Gripper Fabric Layer
12 Button Magnet-Positive Polarity
14 Waterproof Fabric Corner Tab
16 Button Magnet-Negative Polarity
20 Adhered or Sewn Border Binder
30 Disposable Towel or Pad

DETAILED DESCRIPTION OF THE INVENTION

Figure 1:
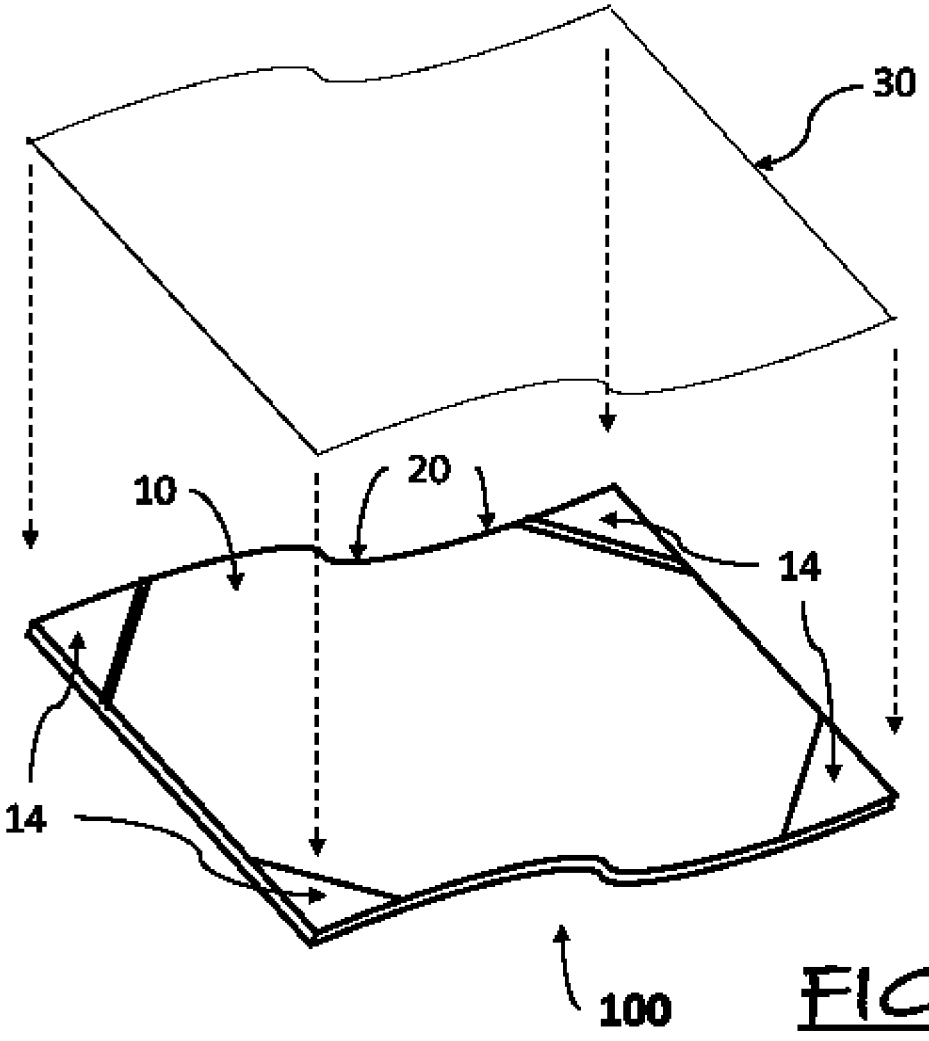
FIG. 1 shows a frontal perspective view of the Disposable Towel and Pad Holding Apparatus 100.

FIG. 1 shows a frontal perspective view of the Disposable Towel and Pad Holding Apparatus 100. While the depicted embodiment reflects a rectangular shape, it is understood that the shape, size, color, materials, texture, and magnetic strength or connection method are all elements of each of the components of the Disposable Towel and Pad Holding Apparatus 100 that are not limited to one specific attribute or characteristic and can be varied without changing the spirit and scope of the present invention.

Figure 2:
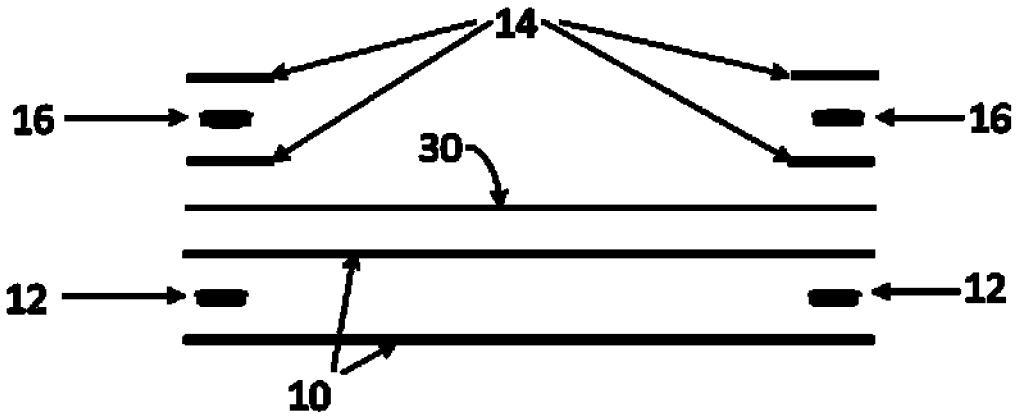
FIG. 2 shows an exploded side view of the main components of the Disposable Towel and Pad Holding Apparatus 100.
Figure 3:
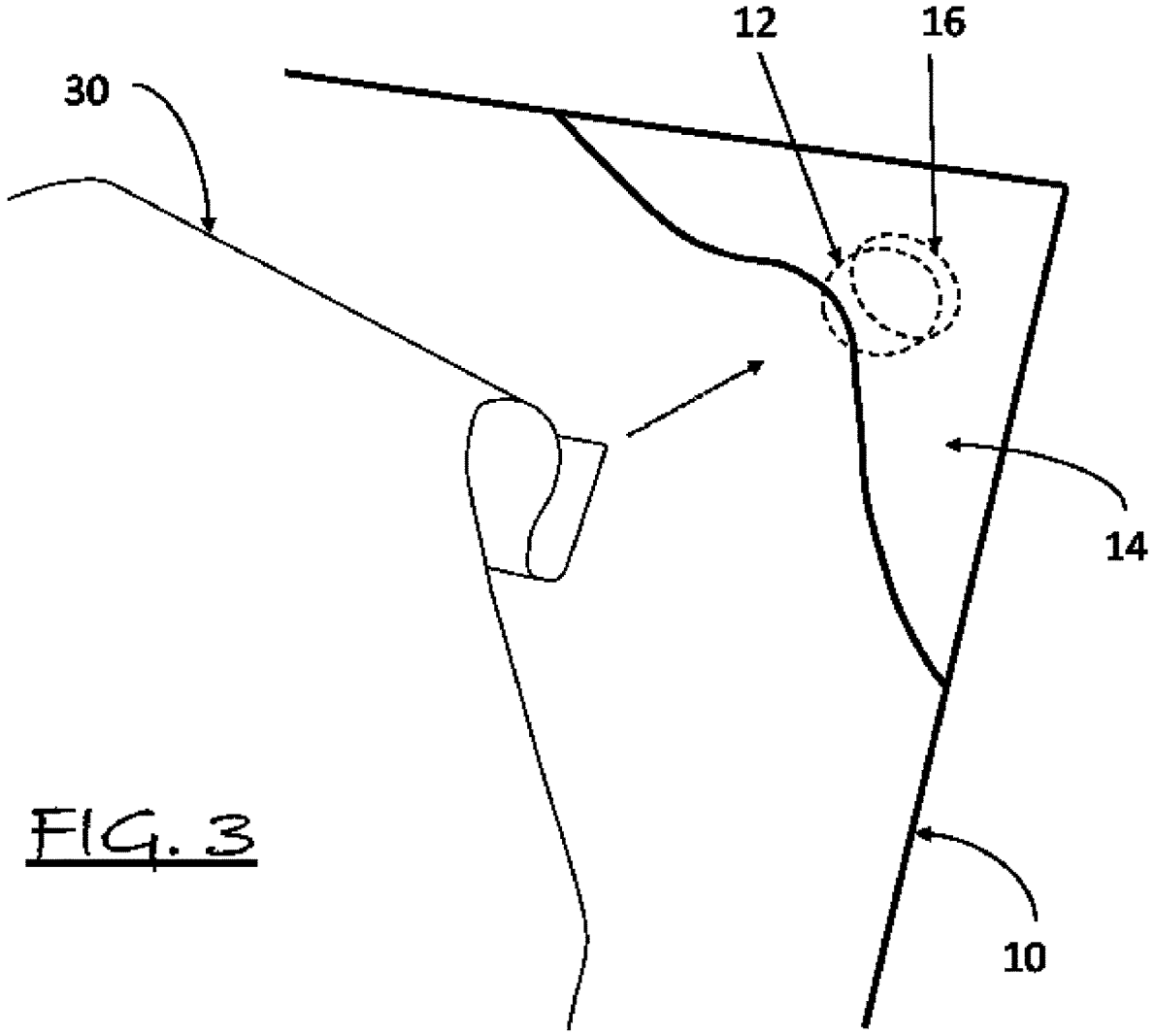
FIG. 3 shows a perspective view of how the Disposable Towel or Pad 30 would be attached to the Disposable Towel and Pad Holding Apparatus 100 via the magnetized corner tabs.

FIG. 2 is an exploded side view of the Disposable Towel and Pad Holding Apparatus 100 and its's major components consisting of two Waterproof Gripper Fabric Layers 10, four Button Magnets-Positive Polarity 12, eight Waterproof Fabric Corner Tabs 14, four Button Magnets-Negative Polarity 16, and an Adhered or Sewn Border Binder 20. The Adhered or Sewn Border Binder 20 can be performed by any number of means including, but not limited to, sewing, surging, heat bonding, gluing, or any other mechanical, chemical or thermodynamic method. The two Waterproof Gripper Fabric Layers 10 are positioned back to back, with their corresponding edges and corners aligned, so that the gripper sides are facing outward. The four Button Magnets-Positive Polarity 12 are positioned one in each corner, between the two Waterproof Gripper Fabric Layers 10, and bonded or sewn in place. The eight Waterproof Fabric Corner Tabs 14 are positioned back to back in pairs, with their corresponding edges aligned. The four Button Magnets-Negative Polarity 16 are positioned between each pairing, one per pairing, of the Waterproof Fabric Corner Tabs 14 and bonded or sewn in place around the outer perimeter of the tabs. These Waterproof Fabric Corner Tabs 14 are then aligned on the second side of the Waterproof Gripper Fabric Layers 10 so that they perfectly align with the 4 corners of the Waterproof Gripper Fabric Layers 10. The entire outer edging, or border, of the Waterproof Gripper Fabric Layers 10 and the correspondingly aligned Waterproof Fabric Corner Tabs 14 are then bonded or sewn in place, forming the Adhered or Sewn Border Binder 20. The Disposable Towel or Pad 30 can then be attached to the Disposable Towel and Pad Holding Apparatus 100 by separating the magnetized Waterproof Fabric Corner Tabs 14, one at a time, and inserting a corresponding corner of the Disposable Towel or Pad 30 between each of the corner magnet sets, subsequently allowing the magnets to pull together, securing those corners of the Disposable Towel or Pad 30 firmly in between, as shown in FIG. 3. The Disposable Towel or Pad 30 can be removed simply by separating the Magnet pairs 12 and 16, in each corner, one at a time, and removing each corner of the Disposable Towel or Pad 30 from between the Magnet pairs 12 and 16, by pulling it from between them.

Operation

To address the problems and drawbacks inherent to multi-use towels or pads and basic disposable towels or pads, a Disposable Towel and Pad Holding Apparatus 100 has been devised and is depicted in FIG. 1. This Disposable Towel and Pad Holding Apparatus 100 provides a permanent and reusable flexible, waterproof, textured, gripper main body that is designed in a way that permits the quick and easy attachment, removal, and replacement of any desired form of Disposable Towel or Pad 30, or any other form of textile, absorbent, or disposable component intended for a multitude of cleaning, absorbing and wiping tasks.

The Disposable Towel and Pad Holding Apparatus 100 is easy and convenient to use for an assortment of tasks. FIG.

3 shows a perspective view of how the Disposable Towel or Pad 30 is attached to the Disposable Towel and Pad Holding Apparatus 100 via the magnetized corners of the embodiment. Begin by laying the Disposable Towel and Pad Holding Apparatus 100 on a flat surface, with the second side face up, with the Waterproof Fabric Corner Tabs 14 facing up. Lay your desired, somewhat equally sized Disposable Towel or Pad 30 over the top of the Disposable Towel and Pad Holding Apparatus 100 and align the edges to each other. One corner at a time, simply lift each Waterproof Fabric Corner Tab 14 to separate its Magnet 16 from the corresponding Magnet 12 in the Waterproof Gripper Fabric Layers 10. Lift the corresponding corner of the Disposable Towel or Pad 30 and tuck it under the corresponding Waterproof Fabric Corner Tab 14 in a manner that positions it between the two Magnets 12 and 16. Release the Waterproof Fabric Corner Tab 14 to firmly secure that corner of the Disposable Towel or Pad 30 to the Waterproof Gripper Fabric Layers 10 via the paired Magnets 12 and 16. Repeat this step for each of the remaining three corners of the apparatus to securely attach the entire Disposable Towel or Pad 30 to the Waterproof Gripper Fabric Layers 10 main body. In a matter of seconds, you are ready to perform your cleaning, absorbing, or liquid application tasks. After the desired task has been performed, the Disposable Towel or Pad 30 is easily removed by lifting each Waterproof Fabric Corner Tab 14 to separate the corresponding Magnets 12 and 16, and the corner of the Disposable Towel or Pad 30 can simply be slid or pulled out. This would be done at each corner of the apparatus to fully release the Disposable Towel or Pad 30 and prepare the Disposable Towel and Pad Holding Apparatus 100 for installation of a new, clean Disposable Towel or Pad 30.

Alternative Methods of the Embodiment

As described thus far, the example of use for the Disposable Towel and Pad Holding Apparatus 100 explained how it pertains to the sport of bowling, but it is certainly, however, not limited to that narrow scope of use. Examples of alternative embodiments and alternative uses are described as follows:

- The Disposable Towel and Pad Holding Apparatus 100 is not limited to any specific properties, as alternate materials, sizes, colors, shapes, textures and bonding and interconnection methods could be used for all components while maintaining the spirit and scope of the embodiment.
- There are many alternative materials that could be used for both the Disposable Towel or Pad 30 layer and the Waterproof Gripper Fabric Layers 10 or main body, that would still maintain the integrity of the entire embodiment's scope, but that would allow for a more exacting match to better meet specific cleaning needs for a specific cleaning use or purpose.
- There are many different methods of connecting the Disposable Towel or Pad 30 layer and the Waterproof Gripper Fabric Layers 10 that would still provide a convenient, quick and easy removal and replacement of the Disposable Towel or Pad 30 layer. In lieu of the Magnet sets 12 and 16, some alternative options for temporary connection are, but not limited to: metal snaps, plastic snaps, buttons, clips, zippers, Velcro (hook and loop fasteners), ties, or any other non-permanent connecting device or non-permanent connecting method of any style.
- An additional design method for the apparatus would involve an additional step to the previous description of the Disposable Towel and Pad Holding Apparatus 100. Once the step of inserting the four corners of the Disposable Towel or Pad 30 into the magnetized Waterproof Fabric Corner Tabs 14 is completed, the four Waterproof Fabric Corner Tabs 14 would then each be folded back and connected to the first side of the Waterproof Gripper Fabric Layer 10 via snaps, plastic snaps, buttons, clips, zippers, Velcro (hook and loop fasteners), ties, or any other non-permanent connecting device or non-permanent connecting method of any type. This would pull and secure the connective means to the first side of the embodiment, away from the wiping surface of the second side of the embodiment, thus eliminating the possibility of the connective means from contacting the surface to be wiped or cleaned, eliminating any chance of marring the surface in any way.
- An additional flap or strap of material or elastic material is sewn to the first side of the waterproof gripping fabric layer allowing user to fit his/her hand into or under said flap or strap to create a more secure grip to the user's hand.
- Should the materials used for the main body of the embodiment not be inherently waterproof, a third layer of equal size and shape that possesses waterproof characteristics would be utilized and would be sandwiched between the two material layers of the main body prior to bonding or sewing, fulfilling the waterproof characteristic of the embodiment.
- The main body of the embodiment can be comprised of a terry cloth, microfiber, chamois, or suede material and in addition to the second side of disposable use, would allow the first side to act as a normal multi-use towel.

Alternative Uses of the Embodiment

- Additional uses or objectives of the Disposable Towel and Pad Holding Apparatus 100 are not limited to bowling, or sports related usage. Additional uses would be evident in the industrial, commercial, service, aerospace and medical industries, as well as for numerous cleaning options within the home environment. Due to its design nature, the embodiment allows full use of a multitude of disposable component options while protecting the users hands from any and all types of moisture, chemicals, oils or any other liquids.
- Since the attachable Disposable Towel or Pad 30 portion of the apparatus is not limited to one specific type of material, the possible uses are quite numerous. Nonwoven textile fabrics have replaced many traditional textiles due to their superior properties and efficient manufacturing processes. Most nonwovens can be effectively produced and finished to have specific benefits such as flame retardancies, high liquid absorbency, liquid repellency, high tensile strength, bacterial resistance, abrasion resistance, softness, and more, and can be manufactured for disposable, reusable, and permanent applications. This presents a broad spectrum of alternative uses by matching the specific type of nonwoven textile to the specific and desired cleaning task. A few examples of the array of alternative uses of this apparatus, simply by specifying a specific type of nonwoven disposable textile, based on the desired cleaning task, could be, but is not limited to:
- Any type of disposable oil absorbent or universal absorbent material (polypropylene for example) could be used as the disposable, if the desired cleaning objective involves soaking up spills or absorbing any liquid substance.

Any type or form of non-woven disposable textile could also be used for small spill cleanup, cleaning or wiping tasks, dusting, or liquid cleaner based cleaning tasks in the industrial, commercial, service, aerospace, and medical industries to name a few, as well as for numerous cleaning options within the home environment.

A nonwoven disposable textile could be used in the sport of golf, in a very similar manner as in bowling, except that it would be used to clean the clubheads between shots, and to clean the ball before putting. It could also be used at the end of the round to clean all clubs, before disposing of the used, dirty disposable component and installing a clean, new disposable component to be utilized in the user's next round.

Other alternative uses of the embodiment that might be apparent by using a specific alternative material or combination of materials could be, but are not limited to:

A multi-purpose kitchen apparatus whereas the second side can be used for small cleanups or spills, and the permanent, reusable first side of the waterproof gripping fabric layer could employ a heat resistant fabric, or heat resistant silicone material, or a combination thereof, and could serve as a potholder, and/or its gripping surface can be used for opening jars as well, while the corner magnets act as a convenient way to store the embodiment between uses by magnetizing to any metal surface such as a refrigerator, stove, or dishwasher.

While a few alternate embodiments of the present invention have been illustrated and described, it would be obvious to those skilled in the art that various other changes and adaptations can be made without departing from the spirit and scope of the invention. All parts and components are not limited to one specified type, material or characteristic as various adaptations or changes to the materials used or sizes, shapes and colors of the components can be made without departing from the spirit and scope of the invention. It is therefore intended to cover in the appended claims all such changes and adaptations that are within the scope of this invention.

The invention claimed is:

1. A disposable towel and pad holding apparatus comprising;

a) a waterproof gripper fabric layer;
b) four waterproof fabric corner tabs;
c) four button magnets—positive polarity;
d) four button magnets—negative polarity;
e) an adhered or sewn border binder;
f) disposable towel or pad;
g) wherein said waterproof gripper fabric layer is comprised of two equally sized layers of waterproof fabric, both possessing a tacky gripping characteristic on at least one of their sides;
h) wherein the two equally sized layers of waterproof fabric are positioned back to back with their corresponding edges and corners aligned, and their tacky gripping sides facing outward;
i) wherein said four button magnets—positive polarity are positioned, one in each corner, between the two equally sized layers of waterproof fabric, each being bonded or sewn in place;
j) wherein the two equally sized layers of waterproof fabric are bonded or sewn together along their corresponding outermost perimeter edges forming said adhered or sewn border binder;
k) wherein said four waterproof fabric corner tabs are each comprised of two equally sized triangular shaped layers of waterproof fabric, positioned back to back with their corresponding edges and corners aligned;
l) wherein said four button magnets—negative polarity, are positioned between the two equally sized triangular shaped layers of waterproof fabric comprising each of the said four waterproof fabric corner tabs, and are secured in place by bonding or sewing the corresponding outermost perimeter edges of the triangular shaped layers of fabric;
m) wherein two of the outermost perimeter edges of said four waterproof fabric corner tabs are placed and aligned with the corresponding outermost perimeter edges of each corner of said waterproof gripper fabric layer and are bonded or sewn together and in place along those corresponding outermost perimeter edges.

2. The device of claim 1, further comprising a flap or strap of material sewn to the hand grip side of said waterproof gripper fabric layer, wherein the flap or strap is a securing device for the user's hand.

* * * * *